US005105880A

United States Patent [19]

Shen

[11] Patent Number: 5,105,880

[45] Date of Patent: Apr. 21, 1992

[54] FORMATION HEATING WITH OSCILLATORY HOT WATER CIRCULATION

[75] Inventor: Joseph J. S. Shen, Brea, Calif.

[73] Assignee: Chevron Research and Technology Company, San Francisco, Calif.

[21] Appl. No.: 600,389

[22] Filed: Oct. 19, 1990

[51] Int. Cl.[5] ..... E21B 43/24; E21B 43/25

[52] U.S. Cl. ..... 166/249; 166/302; 166/303

[58] Field of Search ..... 166/249, 272, 302, 303, 166/177, 57

[56] References Cited

U.S. PATENT DOCUMENTS

| | | | |
|---|---|---|---|
| 2,670,801 | 3/1954 | Sherborne | 166/249 |
| 2,700,422 | 1/1955 | Bodine, Jr. | 166/249 |
| 3,133,591 | 5/1964 | Brandon | 166/303 |
| 3,465,826 | 9/1969 | Terwilliger | 166/303 |
| 3,616,857 | 11/1971 | Pitkethly et al. | 166/302 |
| 3,754,598 | 8/1973 | Holloway, Jr. | 166/249 |
| 4,049,053 | 9/1977 | Fisher et al. | 166/249 |
| 4,057,106 | 11/1977 | Clingman | 166/303 |
| 4,305,463 | 12/1981 | Zakiewicz | 166/249 |
| 4,417,621 | 11/1983 | Medlin et al. | 166/249 |
| 4,783,585 | 11/1988 | Meshekow | 166/303 |

OTHER PUBLICATIONS

U. H. Kurzweg et al., "Heat Transfer by High-Frequency Oscillations: A New Hydrodynamic Technique for Achieving Large Effective Thermal Conductivities", *Phys. Fluids*, 27 (11), Nov., 1984, pp. 2624–2627.

*Primary Examiner*—George A. Suchfield
*Attorney, Agent, or Firm*—E. A. Schaal; E. J. Keeling

[57] ABSTRACT

A portion of a formation is heated by introducing heated water into a borehole within the formation and imposing an oscillatory motion onto the heated water. The heated water can be introduced into the borehole by injecting water into the borehole and heating in situ the injected water, or by injecting heated water into the borehole, or by heating in situ water already present within the borehole. In one embodiment, the heated water is maintained as a liquid phase at a temperature of at least 180° F. within the borehole by using electrically driven paddles to impose upon the heated water oscillatory motion having a frequency of from 1 to 100 hertz.

5 Claims, 1 Drawing Sheet

FORMATION HEATING WITH OSCILLATORY HOT WATER CIRCULATION

The present invention relates to a method for heating a portion of a formation to lower the viscosity of oils within that formation.

BACKGROUND OF THE INVENTION

In the production of heavy and viscous hydrocarbon fluids, these fluids often need to be heated up inside the subterranean formation. At a higher temperature, the heavy oil becomes less viscous and can flow easier through the porous channels in the formation.

There are many ways to heat up the fluids. The most common method is to inject water that is at a higher temperature than that of the formation. Often, steam is injected because it has a much higher heat content than hot water. The injected steam cools down and condenses as it contacts the cooler formation rocks and fluids. During this condensation process, energy is transferred to the cooler surroundings. In general, steam can heat up and thin out the heavy oil more quickly than ordinary hot water injection.

There are two types of steaming operation that are currently used in oil fields. In the first type, steam is injected continuously into the formation to push the hydrocarbon fluids toward production wells. Toward the end of this continuous steaming process (which can last many years) hot water is usually injected to scavenge the remaining heated hydrocarbon fluids. Finally, cold water is injected as the push water after hot water injection is deemed not economical anymore.

In the second type of steaming operation, steam is injected into the formation for a certain period and then the injection is stopped. During this "soaking" period, the injected steam presumably condenses and thereby heats up the reservoir fluids. The heated hydrocarbon fluids and the condensate of injected fluid are then produced back from the same well. This process is commonly called cyclic steaming or the "huff-n-puff" process.

SUMMARY OF THE INVENTION

The present invention is a method for heating a portion of a formation. In that method, heated water is introduced into a borehole within the formation, and an oscillatory motion is imposed onto the heated water. The heated water can be introduced into the borehole: (1) by injecting water into the borehole and heating in situ the injected water, or (2) by injecting heated water into the borehole, or (3) by heating in situ water already present within the borehole.

Preferably, the heated water within the borehole is maintained as a liquid phase at a temperature of at least 180° F. and the oscillatory motion has a frequency of from 1 to 100 hertz. The oscillatory motion can be imposed onto the heated water by using electrically driven paddles. The heated water can be saline.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
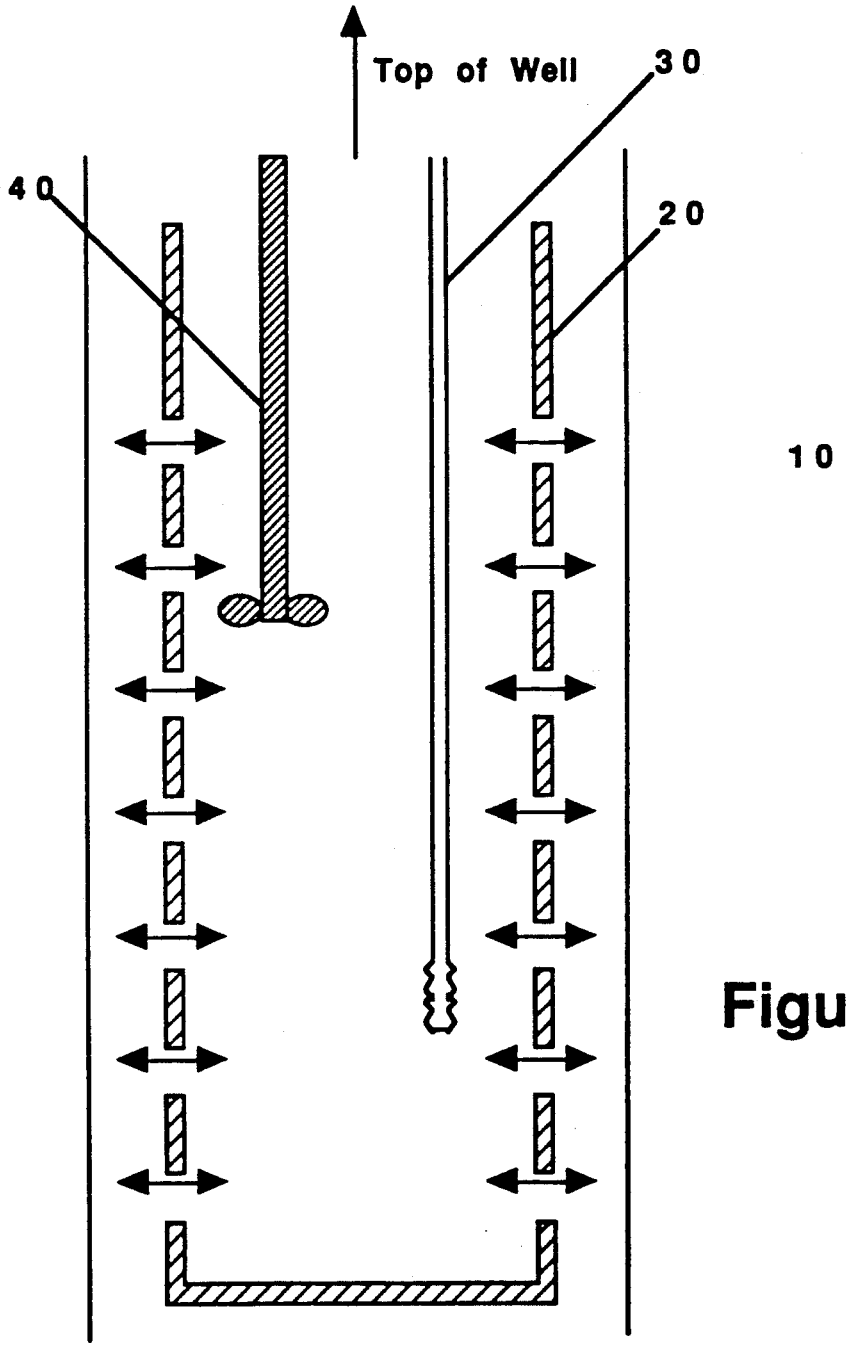
FIG. 1 is a schematic drawing of one embodiment of the present invention.

In its broadest aspect, the present invention is a method for heating a portion of a formation. That method comprises introducing heated water into a borehole within the formation, and imposing an oscillatory motion onto the heated water.

The present invention is an improvement over both type of steaming processes. Hot water is injected, instead of steam. That hot water is made to oscillate at a certain frequency. Heat will then be transferred efficiently from the oscillating hot water to the cold reservoir fluids to achieve the desired thinning-out effect for the viscous oil.

This invention is based in part on the reported findings by Kurzweg and Zhao (1984) that an oscillatory heat source can transfer heat very effectively through very small channels to a heat sink. They observed that the heat transfer rate was enhanced by a great deal compared to ordinary heat conduction due to the imposed fluid oscillatory motion and the small dimensions of the fluid passage channels. They felt that the process would be suited for the removal of heat from hazardous substances (radioactive fluids) and under zero gravity conditions.

The present invention uses an effective heat transfer process to transfer heat from the oscillatory hot water in the well bore through the micropores in the reservoir rocks to the cold hydrocarbon fluids. In the present invention, as shown schematically in FIG. 1, the heat source is hot water in the injection well bore. The hot water in the well bore can be maintained at a high temperature (near 200° to 210° F. but below the boiling point) by a downhole heater or other suitable means. The heat sink is the cold hydrocarbon fluids inside the formation away from the well bore. The very small channels are the interconnecting pores existing inside the reservoir rock.

Ordinarily, heat conduction between hot water in the injection well bore and the surrounding cold hydrocarbon fluids is so slow to be impractical. But, when a high frequency of fluid oscillation is used (from 1 to 100 cycles per second (hertz) for very small pores of reservoir rock (from 1 to 100 microns), the thermal conductivity could be 100 times higher than that for simple heat conduction. This effective heat transfer phenomenon, under the combination of imposed oscillatory hot water at a high frequency and the existing small pore size in reservoir rocks, makes this invention a viable process for practical petroleum production.

The present invention has a variety of advantages over the current practices of injecting steam into the hydrocarbon formation for enhanced oil recovery.

Steam is expensive to generate. It takes energy input to change water into vapor. It also takes large and costly capital equipment, such as steam generator, boiler feed water pretreatment, and insulated pipeline distribution network, to feed the steam from a central plant to the injection wells. In comparison, only hot water is needed in this invention. Less energy is needed to heat water from an ambient temperature to near 200° F. than to produce steam, since no heat of vaporization is needed.

Steam usually condenses, and loses a portion of its heat content, as it is injected downhole. This well bore heat loss is not present in the present invention.

When steam injection is used, a compatibility problem may develop between the rock formation and fresh water from condensed steam. This undesirable "water shock" problem can cause large permeability reduction in the formation as clays in the reservoir pores swell up and block fluid passage when in contact with fresh water. In the present invention, hot saline water can be used to eliminate this problem.

In cyclic steam injection, essentially all steam condensate must be produced back before the oil will follow. In the present invention, with oscillatory motion, little hot water in the well bore flows into the formation. Only heat is transferred into the hydrocarbon fluids in the pores, in contrast to the current arts where steam flows into the formation and mixes with the hydrocarbon fluids to effect the heat transfer. Little additional water needs to be produced back in this invention.

The present invention has less adverse effects on permeability. In steam injection, the vicinity near the well bore is saturated with water due to the injected and condensed steam. That high water content in a reservoir rock hinders the oil movement. In the present invention, with less hot water flowing into the formation, the water content near the well bore is not increased significantly. Where little water flows into the formation, the oil would tend to flow out more easily around the well bore region during the produce-back period.

There are a variety of ways of introducing heated water into the borehole. By "introducing heated water," we mean that we cause heated water to be present within the borehole. It doesn't really matter how that heated water comes to be present, as long as it is present. By "heated water," we mean water that has a temperature higher than its surroundings. One way of introducing heated water is by injecting water into the borehole and heating the injected water in situ. Another way is by injecting heated water into the borehole. A third way is by heating in situ water already present within the borehole.

Preferably, the heated water is saline water. By "saline water," we mean water that contains dissolved salts.

Preferably, the heated water is maintained as a liquid phase at a temperature of at least 180° F. within the borehole. It is important to maintain the water as a liquid phase because the enhanced heat transfer mechanism used in this process requires liquid water to be the medium to conduct heat efficiently away from the borehole. Vaporizing the liquid water within the borehole consumes a large amount of energy without augmenting the rate of heat transfer in this process.

It is important to maintain the water at a temperature of at least 180° F. because the higher the temperature of the hot water in the borehole, the faster the heat will be conducted into the formation. This is due to the larger temperature differential between the heat source and the heat sink.

By "oscillatory motion," we mean that the fluids inside the borehole, as well as inside the formation rock micropores near the wellbore, undergo a back-and-forth motion in a roughly sinusoidal pattern at approximately stationary position with very little displacement of fluids.

Preferably, the oscillatory motion has a frequency of from 1 to 100 hertz. This is desirable because the combination of this frequency range and the range of micropore dimensions commonly found in hydrocarbon formation rocks will result in effective and efficient rate of heat transfer through the oscillatory motion of fluids in the boundary layer inside the micropore channels.

Referring to FIG. 1, a perforated wellbore 20 is placed into a hydrocarbon-containing formation 10. Water is introduced into the wellbore. While in the wellbore, that water is heated by heating element 30. Once the water has been heated to the desired temperature, oscillation generator 40 imposes an oscillatory motion onto the heated water. That oscillatory motion increases the rate of heat transfer from the water to the formation.

While the present invention has been described with reference to specific embodiments, this application is intended to cover those various changes and substitutions that may be made by those skilled in the art without departing from the spirit and scope of the appended claims.

What is claimed is:

1. A method for heating a portion of a formation comprising:

(a) introducing heated water into a borehole within said formation, wherein the heated water is maintained as a liquid phase at a temperature of at least 180° F. within said borehole, and (b) imposing an oscillatory motion onto said heated water, wherein the oscillatory motion has a frequency of from 1 to 100 hertz.

2. A method according to claim 1 wherein the heated water is introduced into said borehole by injecting water into said borehole and heating in situ said injected water.

3. A method according to claim 1 wherein the heated water is introduced into said borehole by injecting heated water into said borehole.

4. A method according to claim 1 wherein the heated water is introduced into said borehole by heating in situ water already present within said borehole.

5. A method according to claim 1 wherein the water is saline water.

* * * * *